US010763631B2

(12) United States Patent
Liu

(10) Patent No.: US 10,763,631 B2
(45) Date of Patent: Sep. 1, 2020

(54) ROTATIONAL OUTLET-SOCKET

(71) Applicant: POWERSYNC INTERNATIONAL CORP., New Taipei (TW)

(72) Inventor: Meng-Chang Liu, New Taipei (TW)

(73) Assignee: POWERSYNC INTERNATIONAL CORP., New Taipei (TW)

( * ) Notice: Subject to any disclaimer, the term of this patent is extended or adjusted under 35 U.S.C. 154(b) by 0 days.

(21) Appl. No.: 16/237,020

(22) Filed: Dec. 31, 2018

(65) Prior Publication Data

US 2020/0212641 A1 Jul. 2, 2020

(51) Int. Cl.

| | |
|---|---|
| ***H01R 35/04*** | (2006.01) |
| ***H01R 24/30*** | (2011.01) |
| ***H01H 13/14*** | (2006.01) |
| ***H01R 13/70*** | (2006.01) |
| ***H01R 25/00*** | (2006.01) |

(52) U.S. Cl.

CPC ..... *H01R 35/04* (2013.01); *H01H 13/14* (2013.01); *H01R 13/70* (2013.01); *H01R 24/30* (2013.01); *H01R 25/006* (2013.01)

(58) Field of Classification Search

CPC ..... H01R 35/04; H01R 13/70; H01R 24/30; H01R 25/006; H01R 24/00; H01H 13/14

See application file for complete search history.

(56) References Cited

U.S. PATENT DOCUMENTS

| | | | | |
|---|---|---|---|---|
| 6,913,467 | B2 * | 7/2005 | Huang | H01R 25/003 439/22 |
| D654,432 | S * | 2/2012 | Brookshire | D13/110 |
| 9,147,984 | B2 * | 9/2015 | Brookshire | H01R 25/003 |
| 9,735,492 | B2 * | 8/2017 | Shum | H01R 35/04 |
| 2002/0195324 | A1 * | 12/2002 | Lee | C08J 9/0004 200/51.03 |
| 2019/0037724 | A1 * | 1/2019 | Franz | G06F 1/18 |

* cited by examiner

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A rotational outlet-socket includes an outlet-socket group including at least two outlet-socket units connected in series, and each outlet-socket unit separately performing rotation in a plurality of angles, where an electric conduction member group is disposed in the outlet-socket unit and includes a first electric conduction rod including a first clamping portion, a second electric conduction rod including a second clamping portion, and a ground wire electric conduction rod including a ground wire clamping portion, and the ground wire clamping portion is pivotally connected to and pivots around the ground wire electric conduction rod through a pivotal connection portion by using a pivotal connection piece. The ground wire clamping portion pivots around a rotation axis between the first clamping portion and the second clamping portion when the outlet-socket unit rotates.

9 Claims, 12 Drawing Sheets

ROTATIONAL OUTLET-SOCKET

BACKGROUND

Technical Field

The invention relates to an outlet-socket, and in particular, to a rotational outlet-socket capable of rotating in a plurality of angles, to avoid a problem of insertion of a plurality of plugs being affected by a limitation on a plug shape.

Related Art

Electricity is indispensable in life in an era of science and technology. To satisfy various requirements for obtaining electricity, power supply outlet-sockets cannot be installed at any place inside a building. As the old gives place to the new in electrical appliance devices, a growing number of household electrical appliances become necessary to life, but the supply of outlet-sockets being capable of providing electricity through insertion of plugs falls short of the demand. Therefore, connecting an extra extension outlet-socket with a plurality of jacks to the mains is a most basic solution.

However, jack directions for a conventional extension outlet-socket are all the same. Usually, a plurality of jacks of the extension outlet-socket can all be effectively used, so that a plurality of plugs can all be simultaneously inserted in the jacks of the extension outlet-socket. However, in recent years, plug appearance styles are diversified based on brands, and in addition, some plugs have rectifier transformers, to transform AC electricity of the mains power supply into DC electricity satisfying use specifications. Therefore, the size and the shape of a plug affect use space of a neighboring outlet-socket.

Therefore, if a plug having a rectifier transformer or having a relatively large size is used, after the plug is inserted into an extension outlet-socket, the rectifier transformer of the plug or a plug shell of the plug covers a jack of another neighboring outlet-socket. Consequently, a plug or a rectifier transformer of another electrical appliance cannot be inserted into the covered jack, thereby reducing a utilization ratio of the extension outlet-socket.

In addition, electrical appliances inserted into a same extension outlet-socket do not have a same plug direction, and electrical appliances in various indoor ranges may be inserted into the same extension outlet-socket. If a plug direction of an electrical appliance is different from a direction of a jack of the outlet-socket, a plug of the electrical appliance needs to be twisted or bent to be smoothly inserted into the jack. Long-time use easily breaks a twisted or bent wire, causing a broken circuit or an electrical fire, and leading to a hazard. This is really a safety problem in electricity use.

SUMMARY

In view of this, a main objective of the invention is to provide a rotational outlet-socket that can rotate in an angle, to match sizes and directions of different electrical appliance plugs, so that an extra extension outlet-socket connected to the mains can achieve an optimal utilization ratio.

To achieve the foregoing objective, the invention relates to a rotational outlet-socket, being mainly an outlet-socket group comprising at least two outlet-socket units connected in series, and each outlet-socket unit being capable of separately performing rotation in a plurality of angles, wherein an electric conduction member group is disposed in each outlet-socket unit, each electric conduction member group comprises a first electric conduction rod, a second electric conduction rod, and a ground wire electric conduction rod, a first clamping portion is disposed on the first electric conduction rod, a second clamping portion is disposed on the second electric conduction rod, a ground wire clamping portion is disposed on the ground wire electric conduction rod, and the ground wire clamping portion is pivotally connected to and pivots around the ground wire electric conduction rod through a pivotal connection portion by using a pivotal connection piece.

Each outlet-socket unit comprises an upper cover comprising a jack group and a lower cover comprising an accommodation groove, and the accommodation groove is in a concave-arc shape, and is used for accommodating the electric conduction member group.

The outlet-socket group comprises a fixing seat, the fixing seat comprises a plurality of spacing rings separating each outlet-socket unit, and a plurality of embedding slot portions accommodated in the outlet-socket unit to buckle each electric conduction member group.

A rotation axis of the pivotal connection portion in each electric conduction member group is between the first clamping portion and the second clamping portion, the ground wire clamping portion pivots around the rotation axis when the outlet-socket unit rotates, and the first clamping portion, the second clamping portion, and the ground wire electric conduction rod do not rotate along with the outlet-socket unit.

The rotational outlet-socket comprises a base, used for accommodating the outlet-socket group.

Switch units corresponding to the number of the at least two outlet-socket units on the outlet-socket group are disposed on the base.

A main switch controlling a power supply of the outlet-socket group is disposed on the base.

The rotational outlet-socket is connected to the mains through a power line.

In this way, an outlet-socket unit pivots in a plurality of angles. When the size of a plug of an electrical appliance is excessively large or an electrical appliance direction is different from a placement direction of a rotational outlet-socket, an angle of each outlet-socket unit in an outlet-socket group may be adjusted, to prevent a neighboring outlet-socket unit having an inserted plug with a relatively large size from being covered, and each outlet-socket unit can rotate based on a direction of the plug of the electrical appliance, to prevent a wire from being twisted and bent, so that a move convenient external extension outlet-socket with a better utilization ratio is provided.

DETAILED DESCRIPTION

Figure 1:
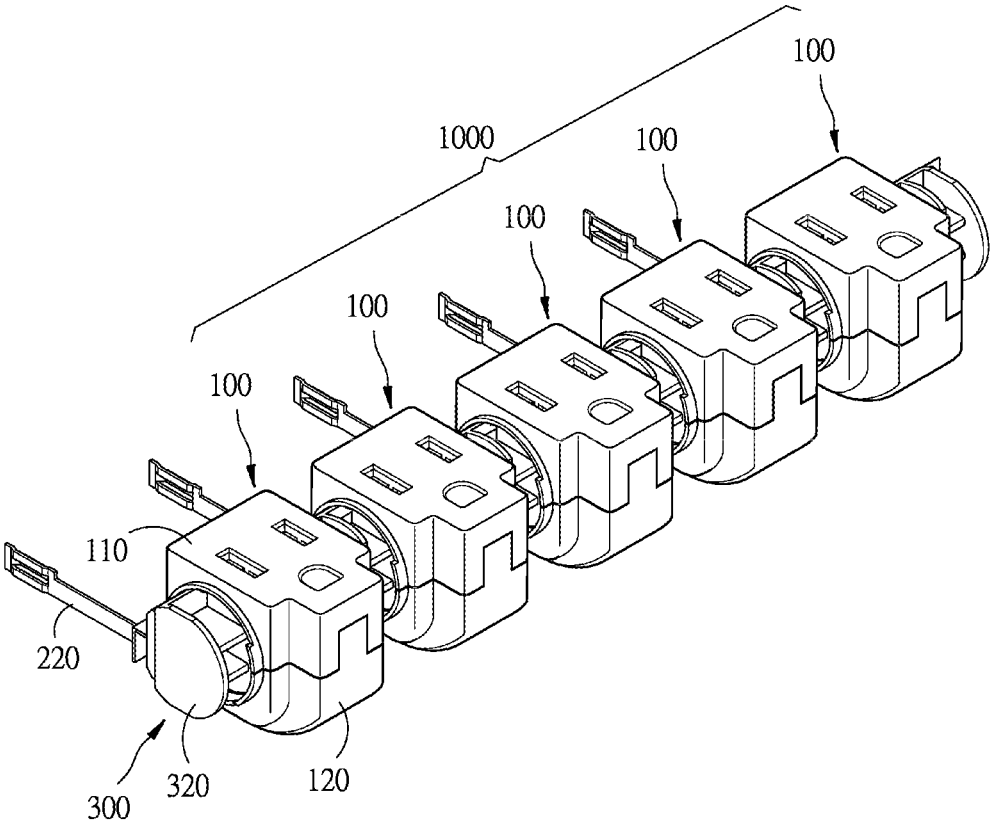
FIG. 1 is a three-dimensional diagram of an outlet-socket group according to the invention.
Figure 2:
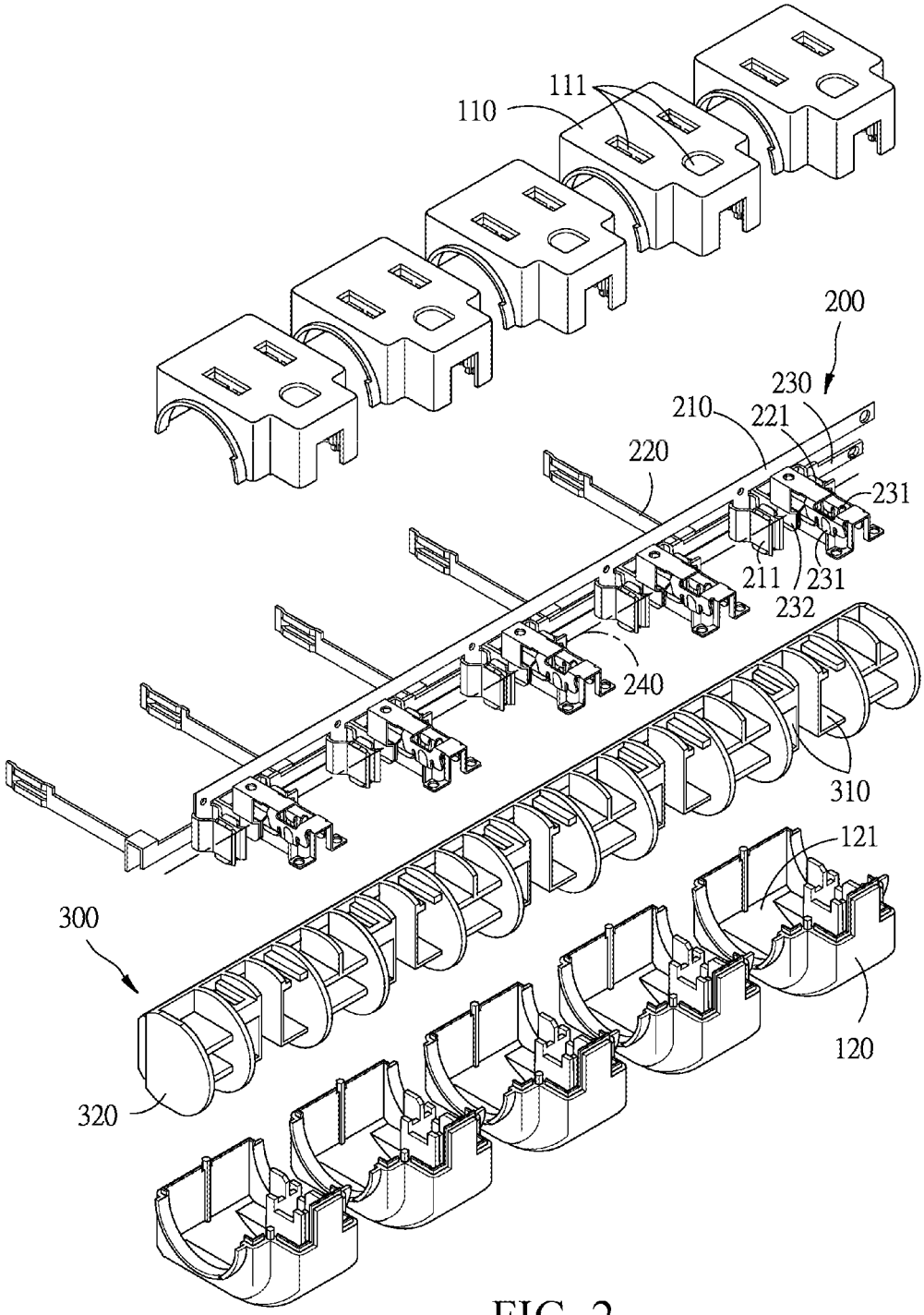
FIG. 2 is an exploded diagram of an outlet-socket group according to the invention.
Figure 3:
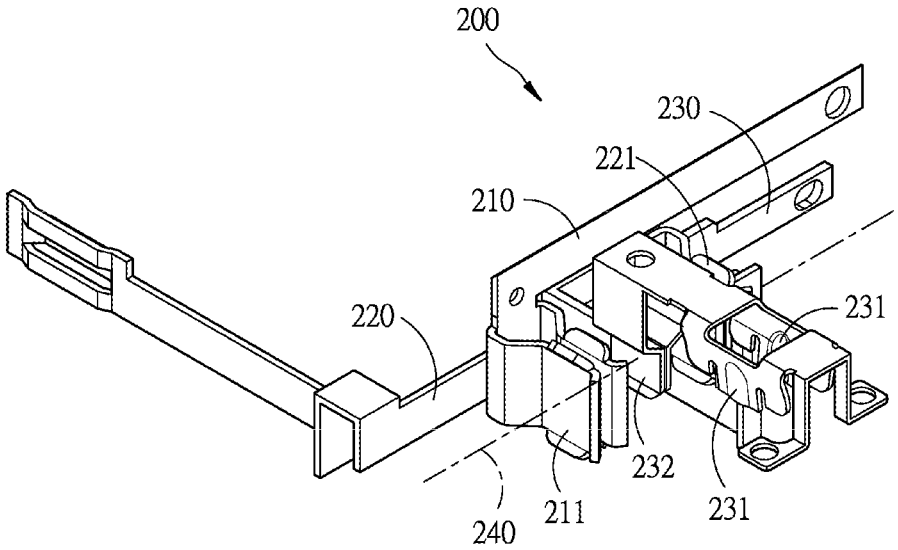
FIG. 3 is a three-dimensional diagram 1 of an electric conduction member group according to the invention.
Figure 4:
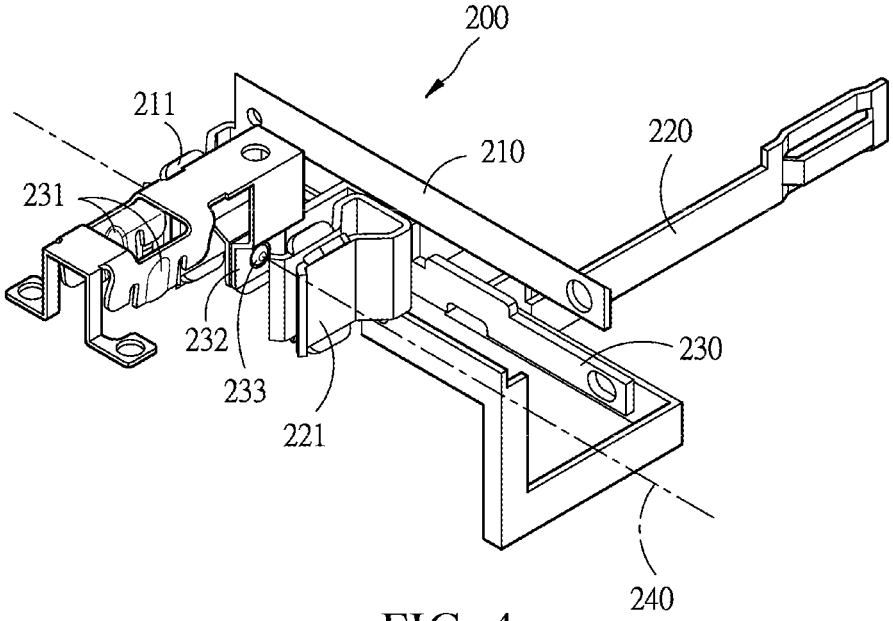
FIG. 4 is a three-dimensional diagram 2 of an electric conduction member group according to the invention.
Figure 5:
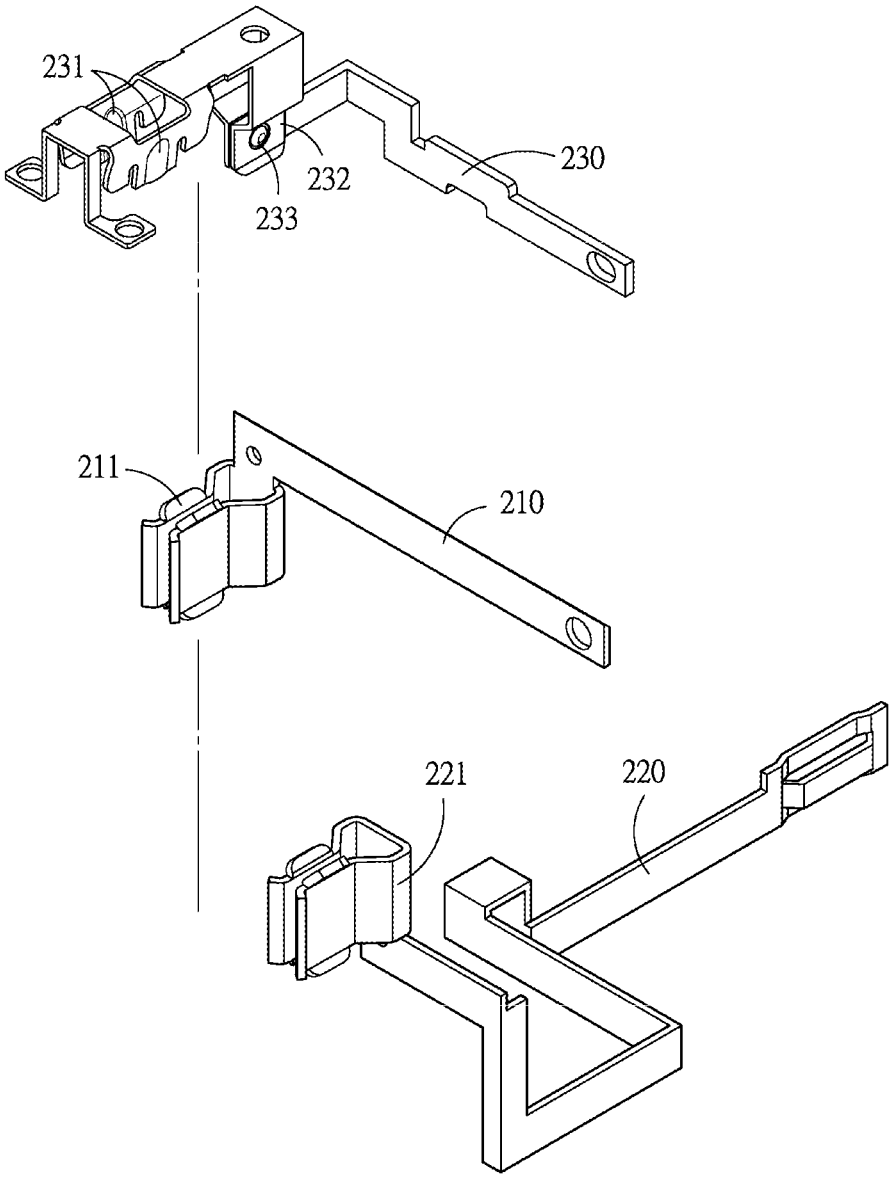
FIG. 5 is an exploded diagram of an electric conduction member group according to the invention.
Figure 6:
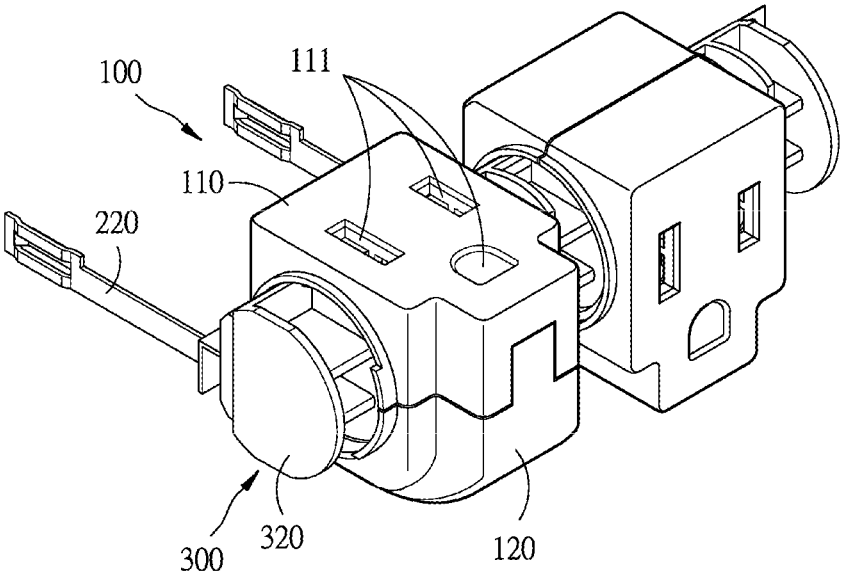
FIG. 6 is a schematic diagram of rotation of an outlet-socket unit according to the invention.
Figure 7:
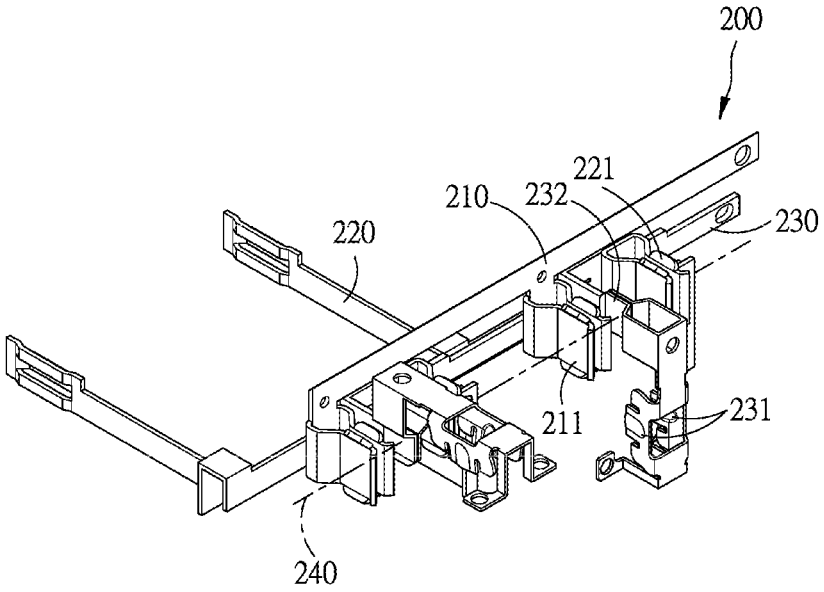
FIG. 7 is a schematic diagram of rotation of an electric conduction member group according to the invention.
Figure 8:
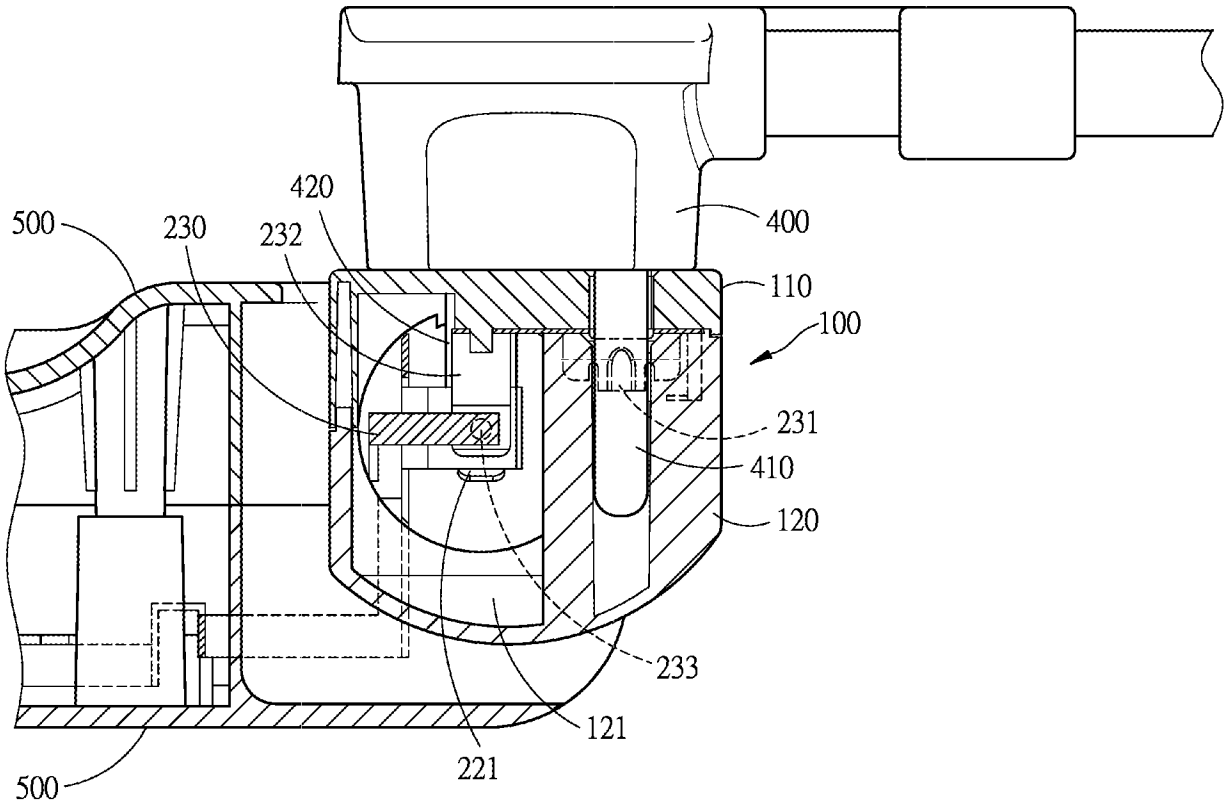
FIG. 8 is a schematic cross-sectional diagram 1 of rotation of a rotational outlet-socket according to the invention.
Figure 9:
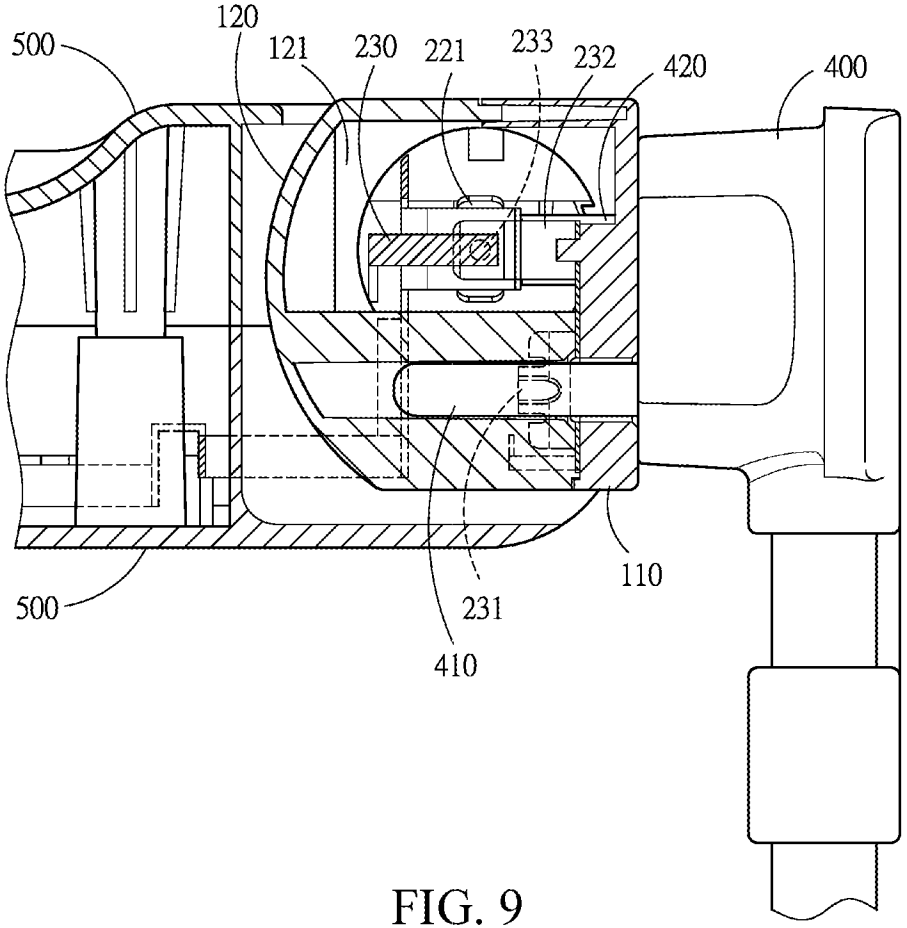
FIG. 9 is a schematic cross-sectional diagram 2 of rotation of a rotational outlet-socket according to the invention.

Detailed content and technologies of the invention are further described herein in the following by using an embodiment. However, it should be understood that, such an embodiment is only used as an example for description, and should not be construed as a limitation to implementation of the invention.

Refer to FIG. 1, FIG. 2, FIG. 3, FIG. 4, and FIG. 5. A rotational outlet-socket is mainly an outlet-socket group 1000 including at least two outlet-socket units 100 connected in series. Five outlet-socket units 100 connected in series are used as a best embodiment in this application. Each outlet-socket unit 100 is capable of separately performing rotation in a plurality of angles, where an electric conduction member group 200 is disposed in each outlet-socket unit 100, each electric conduction member group 200 includes a first electric conduction rod 210, a second electric conduction rod 220, and a ground wire electric conduction rod 230, a first clamping portion 211 is disposed on the first electric conduction rod 210, a second clamping portion 221 is disposed on the second electric conduction rod 220, a ground wire clamping portion 231 is disposed on the ground wire electric conduction rod 230, and the ground wire clamping portion 231 is pivotally connected to and pivots around the ground wire electric conduction rod 230 through a pivotal connection portion 233 by using a pivotal connection piece 232.

Each outlet-socket unit 100 includes an upper cover 110 including a jack group 111 and a lower cover 120 including an accommodation groove 121, and the accommodation groove 121 is in a concave-arc shape, and is used for accommodating the electric conduction member group 200. Further, the outlet-socket group 1000 includes a fixing seat 300, the fixing seat 300 includes a plurality of spacing rings 320 separating each outlet-socket unit 100, and a plurality of embedding slot portions 310 accommodated in the outlet-socket unit 100 to buckle each electric conduction member group 200, so that each outlet-socket unit 100 can separately rotate in different angles, and is not linked to each other.

A rotation axis 240 of the pivotal connection portion 233 in each electric conduction member group 200 is between the first clamping portion 211 and the second clamping portion 221, the ground wire clamping portion 231 pivots around the rotation axis 240 when the outlet-socket unit 100 rotates, and the first clamping portion 211, the second clamping portion 221, and the ground wire electric conduction rod 230 do not rotate along with the outlet-socket unit 100.

During implementation, also refer to FIG. 6, FIG. 7, FIG. 8, and FIG. 9. In the figures, two outlet-socket units 100 are connected in series, to show a difference before and after rotation. In the figures, a pivoting angle of the pivotal connection portion 233 is in a range of 0 degrees to 90 degrees, that is, a direction of the jack group 111 on the outlet-socket unit 100 can be changed from upward to sideward through rotation.

When the outlet-socket unit 100 is in a normal state without rotation, the jack group 111 on the outlet-socket unit 100 faces upward. The first conduction pole piece clamp 211 and the second conduction pole piece clamp 221 in the outlet-socket unit 100 are fastened in the embedding slot portion 310 of the fixing seat 300, and an opening clamped by the ground wire clamping portion 231 and the jack group 111 also face upward. When the outlet-socket unit 100 starts to rotate, the first conduction pole piece clamp 211 and the second conduction pole piece clamp 221 are still fastened in the embedding slot portion 310 of the fixing seat 300, and kept in original locations and original directions together with the fixing seat 300 without shifting. Only the pivotal connection piece 232 extending from the ground wire clamping portion 231 drives, through the pivotal connection portion 233, the ground wire clamping portion 231 to rotate in different angle ranges around the rotation axis 240 between the first conduction pole piece clamp 211 and the second conduction pole piece clamp 221. When a plug 400 is inserted into the jack group 111 on the outlet-socket unit 100, the ground wire clamping portion 231 can drive, through the pivotal connection portion 233, a ground wire pole piece 410 of the plug 400 inserted therein to pivot. When the plug 400 is inserted into the jack group 111, a live wire pole piece and a neutral wire pole piece 420 on the plug 400 are respectively inserted into the first conduction pole piece clamp 211 and the second conduction pole piece clamp 221. When the ground wire clamping portion 231 drives the plug 400 to pivot, the first conduction pole piece clamp 211 and the second conduction pole piece clamp 221 do not shift, but the live wire pole piece and the neutral wire pole piece 420 inserted therein rotate along with the plug 400, and rotate around the rotation axis 240 in the first conduction pole piece clamp 211 and the second conduction pole piece clamp 221.

Figure 10:
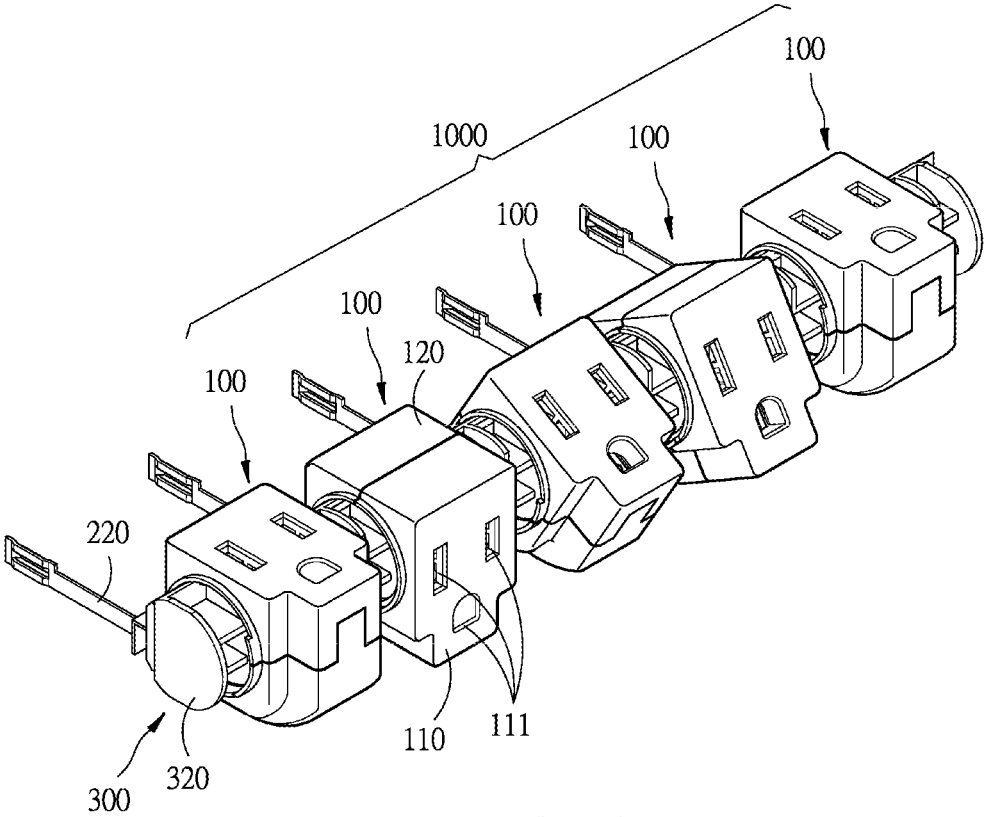
FIG. 10 is a schematic diagram of rotation of an outlet-socket group according to the invention.

Refer to FIG. 10. The foregoing content indicates that, when the outlet-socket unit 100 rotates, the fixing seat 300, and the first electric conduction rod 210 and the second electric conduction rod 220 buckled in the embedding slot portion 310 do not rotate along, and only the ground wire clamping portion 231 of the electric conduction member group 200 rotates around the rotation axis 240 by using the pivotal connection portion 233. Therefore, when the outlet-socket unit 100 is in a state without rotation, the jack group 111 on the outlet-socket unit 100 faces upward. When the outlet-socket unit 100 starts to rotate, a direction of the jack group 111 on the upper cover 110 is changed to sideward, and each outlet-socket unit 100 on the outlet-socket group 1000 can separately present a different direction through rotation, without being restricted by a neighboring outlet-socket unit 100, so that different electrical appliance plugs 400 can be inserted into the jack group 111 without being limited by directions.

Figure 11:
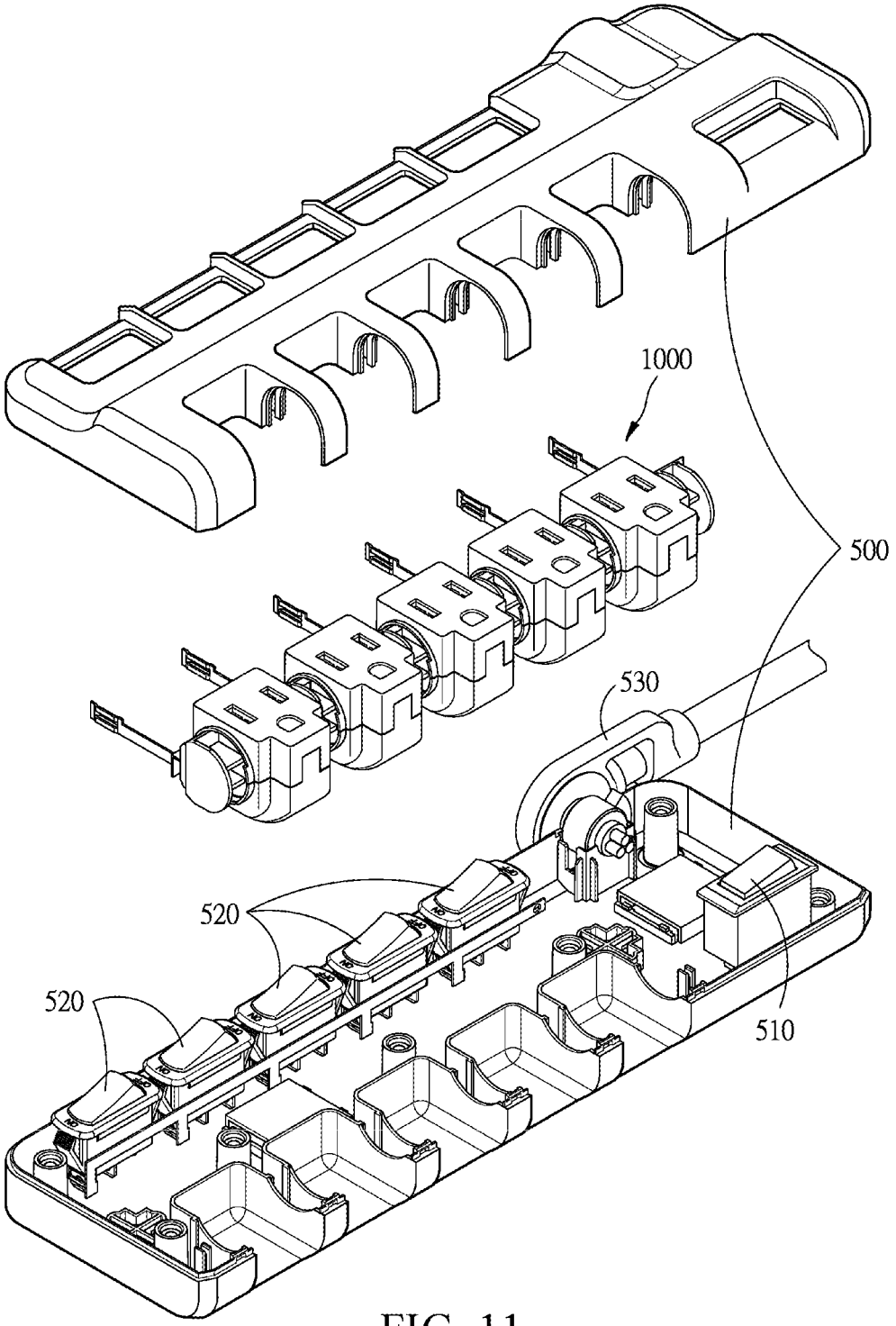
FIG. 11 is a schematic diagram of a base according to the invention.
Figure 12:
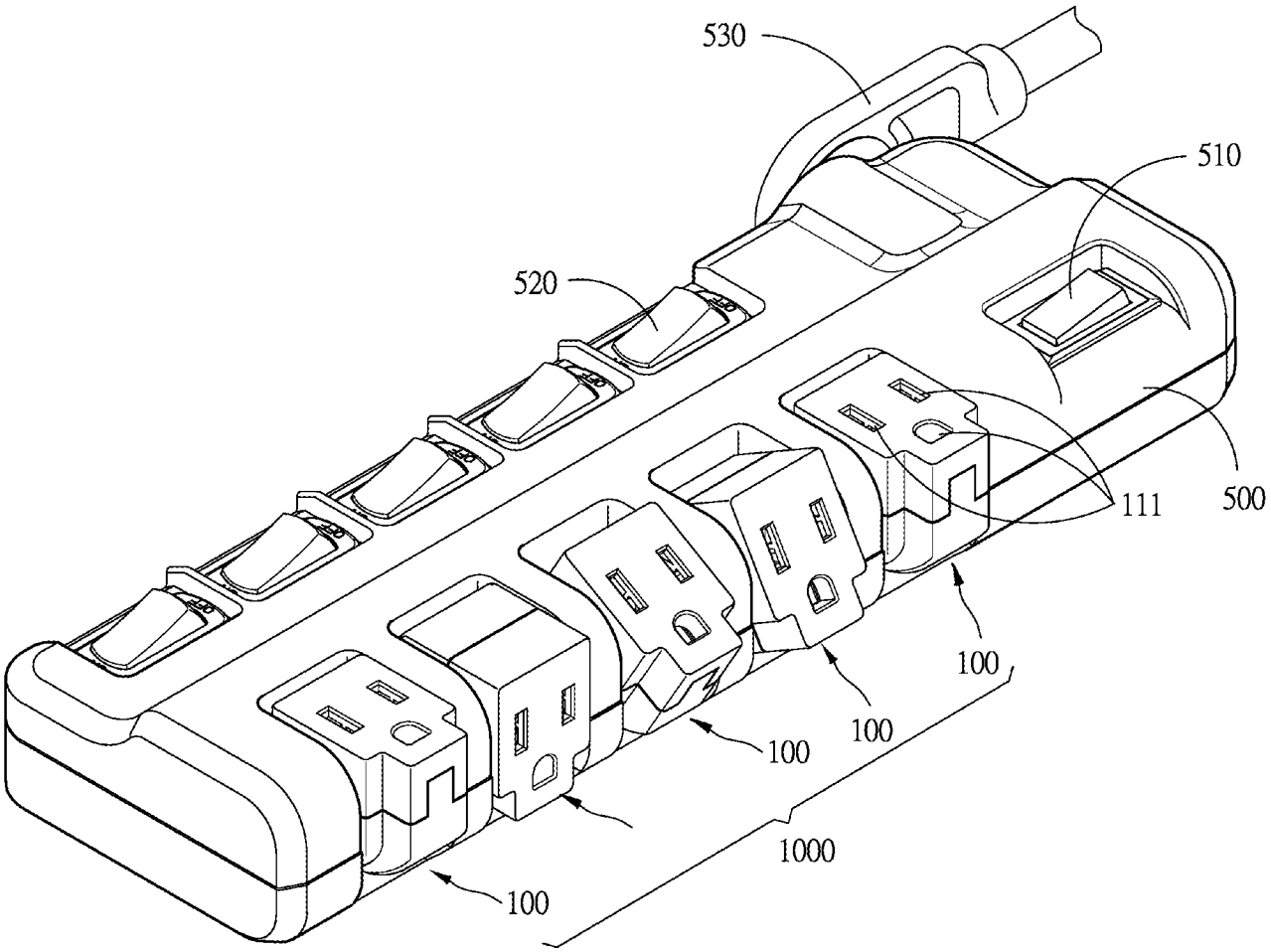
FIG. 12 is a schematic diagram of use of a rotational outlet-socket according to the invention.

Also refer to FIG. 11 and FIG. 12. The rotational outlet-socket includes a base 500, used for accommodating the outlet-socket group 1000. The base 500 is connected to the mains through a power line 530. A main switch 510 controlling a power supply of the outlet-socket group is disposed on the base 500. A plurality of switch units 520 corresponding to the number of these outlet-socket units 100 on the outlet-socket group 1000 is disposed on the base 500. The power supply of the outlet-socket group 1000 is switched on or off through the main switch 510, and current supply to each outlet-socket unit 100 is controlled by using different switch units 520.

In this way, the outlet-socket unit 100 can rotate in different angles in a rotation range, without being limited by the size of a neighboring plug 400. Only the outlet-socket unit 100 needs to be rotated by an angle, to avoid a problem of inconvenient insertion caused by the excessively large plug 400 shielding the neighboring jack group 111 and a direction of the plug 400 being different from a placement direction of the outlet-socket group 1000.

The invention is already described in the foregoing by using the preferred embodiment, but a person skilled in the art should understand that, the embodiment is only used for describing the invention and should not be construed as a limitation to the scope of the invention. It should be noted that, all variations and replacements equivalent to the embodiment should fall within the scope of the invention. Therefore, the protection scope of the invention should be subjected to that defined in the claims.

What is claimed is:

1. A rotational outlet-socket, being mainly an outlet-socket group comprising at least two outlet-socket units connected in series, and each outlet-socket unit being capable of separately performing rotation in a plurality of angles, wherein an electric conduction member group is disposed in each outlet-socket unit, each electric conduction member group comprises a first electric conduction rod, a second electric conduction rod, and a ground wire electric conduction rod, a first clamping portion is disposed on the first electric conduction rod, a second clamping portion is disposed on the second electric conduction rod, a ground wire clamping portion is disposed on the ground wire electric conduction rod, and the ground wire clamping portion is pivotally connected to and pivots around the ground wire electric conduction rod through a pivotal connection portion by using a pivotal connection piece; and a rotation axis of the pivotal connection portion in each electric conduction member group is between the first clamping portion and the second clamping portion, the ground wire clamping portion pivots around the rotation axis when the outlet-socket unit rotates, and the first clamping portion, the second clamping portion, and the ground wire electric conduction rod do not rotate along with the outlet-socket unit.

2. The rotational outlet-socket according to claim 1, wherein each outlet-socket unit comprises an upper cover comprising a jack group and a lower cover comprising an accommodation groove, and the accommodation groove is in a concave-arc shape, and is used for accommodating the electric conduction member group.

3. The rotational outlet-socket according to claim 1, wherein the outlet-socket group comprises a fixing seat, the fixing seat comprises a plurality of spacing rings separating each outlet-socket unit, and a plurality of embedding slot portions accommodated in the outlet-socket unit to buckle each electric conduction member group.

4. The rotational outlet-socket according to claim 1, comprising a base, used for accommodating the outlet-socket group.

5. The rotational outlet-socket according to claim 4, wherein switch units corresponding to a number of the at least two outlet-socket units on the outlet-socket group are disposed on the base.

6. The rotational outlet-socket according to claim 4, wherein a main switch controlling a power supply of the outlet-socket group is disposed on the base.

7. The rotational outlet-socket according to claim 1, wherein the rotational outlet-socket is connected to mains through a power line.

8. A rotational outlet-socket, being mainly an outlet-socket group comprising at least two outlet-socket units connected in series, and each outlet-socket unit being capable of separately performing rotation in a plurality of angles, wherein an electric conduction member group is disposed in each outlet-socket unit, each electric conduction member group comprises a first electric conduction rod, a second electric conduction rod, and a ground wire electric conduction rod, a first clamping portion is disposed on the first electric conduction rod, a second clamping portion is disposed on the second electric conduction rod, a ground wire clamping portion is disposed on the ground wire electric conduction rod, and the ground wire clamping portion is pivotally connected to and pivots around the ground wire electric conduction rod through a pivotal connection portion by using a pivotal connection piece; and the outlet-socket group comprises a fixing seat, the fixing seat comprises a plurality of spacing rings separating each outlet-socket unit, and a plurality of embedding slot portions accommodated in the outlet-socket unit to buckle each electric conduction member group.

9. A rotational outlet-socket, being mainly an outlet-socket group comprising at least two outlet-socket units connected in series, and each outlet-socket unit being capable of separately performing rotation in a plurality of angles, wherein an electric conduction member group is disposed in each outlet-socket unit, each electric conduction member group comprises a first electric conduction rod, a second electric conduction rod, and a ground wire electric conduction rod, a first clamping portion is disposed on the first electric conduction rod, a second clamping portion is disposed on the second electric conduction rod, a ground wire clamping portion is disposed on the ground wire electric conduction rod, and the ground wire clamping portion is pivotally connected to and pivots around the ground wire electric conduction rod through a pivotal connection portion by using a pivotal connection piece; and the rotational outlet-socket is connected to mains through a power line.

* * * * *